US006175484B1

(12) United States Patent
Caruthers et al.

(10) Patent No.: US 6,175,484 B1
(45) Date of Patent: Jan. 16, 2001

(54) ENERGY RECOVERY CIRCUIT CONFIGURATION FOR SOLENOID INJECTOR DRIVER CIRCUITS

(75) Inventors: Michael A. Caruthers, Peoria, IL (US); Errol W. Davis, Neuenhain Bad Soden (DE); Chien C. Lee, Peoria; William J. Love, Dunlap, both of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/259,942

(22) Filed: Mar. 1, 1999

(51) Int. Cl.[7] ..... H01H 47/00
(52) U.S. Cl. ..... 361/159; 361/154
(58) Field of Search ..... 361/152–156, 361/159, 160, 191

(56) References Cited

U.S. PATENT DOCUMENTS 5,532,526 * 7/1996 Ricco et al. ..... 361/152
5,717,562 2/1998 Antone et al. ..... 361/155
5,757,224 5/1998 Antone et al. ..... 327/538
5,877,931 * 3/1999 Groppo et al. ..... 361/152

* cited by examiner

*Primary Examiner*—Fritz Fleming
(74) *Attorney, Agent, or Firm*—Haverstock, Garrett & Roberts

(57) ABSTRACT

A circuit configuration wherein a plurality of solenoid driver circuits are all coupled together such that the high voltage supply associated with one driver circuit is connected in parallel with the high voltage supply of another driver circuit. Each driver circuit includes a high voltage select switch, a select switch, and a modulation switch, all of which switches are coupled to and controlled by an electronic controller such that back EMF created by the solenoid coil in each respective driver circuit can be recaptured by charging the high voltage supply associated with that driver circuit. This recaptured energy can then be utilized to not only provide current flow to the solenoid coil associated with that particular driver circuit, but such energy can likewise be utilized to recharge any plurality of the other high voltage supplies associated with the other driver circuits, even while the solenoid coils of such driver circuits are being powered by their respective high voltage supply.

15 Claims, 4 Drawing Sheets

ENERGY RECOVERY CIRCUIT CONFIGURATION FOR SOLENOID INJECTOR DRIVER CIRCUITS

TECHNICAL FIELD

This invention relates generally to solenoid driver circuits and, more particularly, to an improved energy recovery circuit configuration wherein any plurality of solenoid injector driver circuits are coupled together in parallel arrangement such that solenoid coil energy (back EMF) recaptured from one driver circuit can be used to recharge the power level of any plurality of other solenoid driver circuits.

BACKGROUND ART

Electronically controlled fuel injection systems must be capable of high speed operation and must have consistently reproducible stroke characteristics. High speed solenoid operation is therefore imperative as slow acting solenoids result in erroneous quantities of fuel being delivered to each cylinder at an inappropriate timing advance which can adversely affect the performance of the engine. A fuel injection solenoid control system can provide advantageous control of engine operation over the entire range of engine speeds by delivering a regulated voltage for a variable duration of time. This results in the solenoid opening the fuel injector for a substantially standard time duration to deliver a substantially standard pre-selected quantity of fuel to each individual cylinder. Typically, the rise time of current flow through the solenoid is a function of the voltage applied. The reproducibility of the stroke characteristics versus the control signal applied to the solenoid improves with higher voltages applied to the solenoid. However, higher voltages typically require higher voltage supplies that add to the expense of the overall driver circuit.

In a typical fuel injection system for a multi-cylinder engine, a fuel injection solenoid is provided for each engine cylinder and power to each solenoid must be supplied and removed for each compression stroke. Typically, the energy stored in the solenoid during energization is transformed into heat by a diode and resistor combination placed in the flyback current path of each solenoid when power is removed from the solenoid. The magnitude of the energy disposed of in this manner is significant and directly results in an increase to the cost of the system.

U.S. Pat. No. 5,717,562 which issued to the present assignee addresses some of the drawbacks associated with the prior art solenoid driver circuits and discloses an energy saving solenoid driver circuit which recovers power normally dissipated by the flyback current path in a conventional solenoid driver. More particularly, the solenoid driver circuit disclosed in U.S. Pat. No. 5,717,562 provides the advantages of a high voltage solenoid driver while eliminating many of the circuit components of the high voltage power supply traditionally associated with such high voltage solenoid drivers, and such driver circuit primarily recaptures solenoid coil energy (back EMF) when power is disconnected from the solenoid coil, that is, when fuel injection for that particular stroke is complete. Also, the high voltage capacitor associated with the driver circuit disclosed in U.S. Pat. No. 5,717,562 is only charged from the back EMF associated with the particular injector solenoid coil located in that particular driver circuit, and such back EMF is not utilized to recharge any high voltage capacitors associated with the other solenoid injector driver circuits in a typical fuel injection system.

It is therefore desirable to provide an energy recovery circuit configuration wherein the high voltage capacitors associated with a plurality of solenoid injector driver circuits can be recharged simultaneously from the back EMF associated with any one or a plurality of the injector solenoid coils associated with such driver circuits, and that such recharging of at least some of the high voltage capacitors can take place even while the injector solenoid coils for some of the driver circuits are being powered by their capacitors for fuel injection to particular cylinders.

Accordingly, the present invention is directed to overcoming one or more of the problems as set forth above.

DISCLOSURE OF THE INVENTION

In accordance with the teachings of the present invention, a plurality of solenoid driver circuits are coupled together such that the high voltage capacitors associated respectively with such driver circuits are connected in parallel with each other, each solenoid driver circuit including a high voltage select switch, a select switch and a modulation switch. One or more electronic controllers are coupled to the plurality of driver circuits and control the opening and closing of the various switches such that the back EMF created by a solenoid coil in one driver circuit can be recaptured and used to not only charge the high voltage capacitor associated with that particular driver circuit, but such energy can likewise be utilized to recharge other high voltage capacitors associated with other driver circuits, even while such other driver circuits are active and the solenoid coils of such other driver circuits are energized to control fuel delivery to the engine.

Although it is generally preferred that each fuel injector be driven by its own solenoid injector driver circuit, it is also recognized and anticipated that any plurality of fuel injectors associated with any plurality of cylinders, within limits, may be driven by a single solenoid driver circuit. In this situation, the solenoid driver circuit may include additional solenoid coils positioned in parallel with each other, each solenoid coil being associated with a specific fuel injector. Regardless of the number of solenoid coils associated with a particular driver circuit, the high voltage capacitors associated with each of these solenoid driver circuits, even though each driver circuit may control more than one fuel injector, may still be coupled to each other in accordance with the teachings of the present invention so as to gain the benefits thereof. In this regard, the respective high voltage capacitor recovery times may vary depending upon how many injector solenoid coils are being driven by each respective solenoid driver circuit.

The present circuit configuration therefore enables the high voltage supply of one driver circuit to charge one or more of the high voltage supplies associated with other driver circuits so as to maintain the various high voltage supplies at a desired voltage level thereby improving the current rise time. In addition, the various high voltage supplies can be simultaneously recharged from a plurality of different solenoid injector driver circuits depending upon the timing of the fuel injection sequence associated with the particular engine involved, and depending upon which solenoid injector driver circuits are recovering power through the flyback current path at or near the same time.

BRIEF DESCRIPTION OF THE DRAWINGS

For a better understanding of the present invention, reference may be made to the accompanying drawings in which.

BEST MODE FOR CARRYING OUT THE INVENTION

The following is a detailed description of several embodiments of the present invention, which invention relates to a control circuit configuration for use with on/off solenoid actuators. Although the various embodiments of the present invention are described in connection with solenoid fuel injector actuators used in a fuel injection system for controlling the delivery of fuel to the various cylinders of a multi-cylinder engine, it is recognized and anticipated that the present invention is not limited to the single application described herein. Instead, the present invention is particularly advantageous for use in a wide variety of other actuator applications where it is important to control the current rise time through the solenoid coil. These applications typically require a high voltage supply to decrease the duration of the initial rise time. Other applications are likewise possible. The present invention provides a high voltage supply without having a dedicated high voltage power supply circuit and teaches a circuit configuration for rapidly recharging a plurality of high voltage capacitors for use in repeated energization of a plurality of solenoid coils even while such capacitors are passing current through the solenoid coils.

Figure 1:
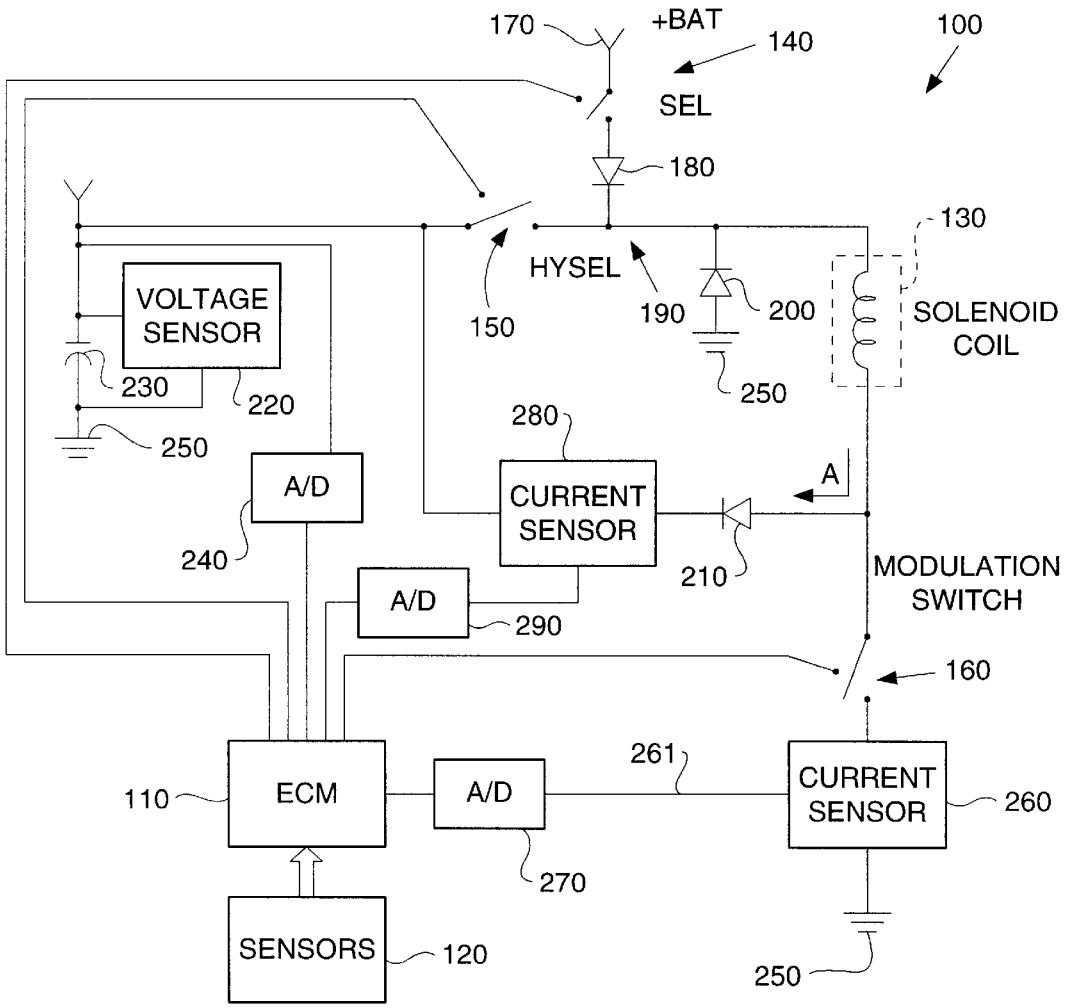
FIG. 1 is a schematic diagram of a known solenoid driver circuit which is utilized in the present invention.

Referring to FIG. 1, numeral 100 in FIG. 1 represents a schematic circuit diagram of a prior art solenoid injector driver circuit which recharges the high voltage capacitor 230 utilized in such circuit with the back EMF created by the solenoid coil 130 when the modulation switch 160 is in its open position. This energy is recovered through the flyback current path indicated by the arrow A illustrated in FIG. 1. The solenoid driver circuit 100 is fully disclosed and described in U.S. Pat. No. 5,717,562 and a detailed explanation of its function and operation can be obtained from a reading of such patent.

The solenoid driver circuit 100 is controlled by an electronic control module (ECM) 110 and a plurality of sensors 120 are typically coupled to the ECM 110 for inputting various information to the ECM for controlling the particular application for which the driver circuit 100 is being utilized, solenoid coil 130 being connected to a particular actuator such as a fuel injector actuator and being operable to control the operation of such actuator, that is, turn the actuator "on" and "off". In the solenoid driver application illustrated herein directed specifically to fuel injectors, such sensors may include an engine speed sensor, a throttle position sensor, a crankshaft position sensor, and various switches controlling the application of various other functions. The ECM 110 receives these various signal inputs and calculates a current command voltage that corresponds to a desired current level. The solenoid driver circuit 100 then controls current to the desired level. The ECM 110 also calculates the time when the current command signal is issued based upon the various sensor inputs. In engine applications, timing and duration of the fuel injection signal are determined in connection with the specific engine hardware configuration being utilized.

Electronic controllers or modules such as the ECM 110 are commonly used in association with engine applications and electronically control the fuel injection systems for controlling and accomplishing various functions and tasks including monitoring and controlling the delivery of fuel to the respective cylinders and fuel injectors associated with a particular engine. In this regard, ECM 110 will typically include processing means, such as a microcontroller or microprocessor, associated electronic circuitry such as input/output circuitry, analog circuits or programmed logic arrays, as well as associated memory.

As shown in FIG. 1, ECM 110 is coupled to and controls the opening and closing of a select switch 140, a high voltage select switch 150, and a modulation switch 160. The select switch 140 is connected between a low voltage source, such as the battery voltage 170, and a first diode 180. The diode 180 is connected to one terminal of each of the high voltage select switch 150, a second diode 200 and the solenoid coil 130 through junction 190. The high voltage select switch 150 is also connected to a third diode 210 and to a voltage sensor 220. The voltage sensor 220 is connected to the high voltage capacitor 230 which is likewise connected to ground 250. In a preferred embodiment, the voltage sensor 220 includes a voltage divider or other similar device or circuitry to scale the voltage across the high voltage capacitor 230 to an appropriate level for an analog to digital (A/D) converter 240 which then converts the analog voltage signal to a corresponding digital value to be read by ECM 110.

ECM 110 is also coupled to a first current sensor 260 which is placed in series with the modulation switch 160 and ground 250. The current sensor 260 produces a current signal via conductive path 261 which is read by ECM 110 through the analog/digital (A/D) converter 270. It is recognized and anticipated that the A/D converters 240 and 270 can be typically combined into a single electrical component, for example, a four channel A/D converter. Other types of interface components or circuits could likewise be substituted for the converters 240 and 270. A second sensor 280 is also preferably connected to ECM 110 through another A/D converter 290. Here again, the A/D converter 290 may likewise be included in the four channel A/D converter or similar components described above.

Current sensor 280 allows ECM 110 to sense current flow accurately through the solenoid coil 130 at all times. When ECM 110 causes the modulation switch 160 to open, current flowing through the solenoid coil 130 will no longer flow through the current sensor 260. As a result, sensor 260 will produce a current signal indicating approximately zero current flow through the solenoid coil 130. However, when the modulation switch 160 opens, current will continue to flow through the flyback path represented by the arrow A in FIG. 1. As a result, when the modulation switch 160 is open, the second current sensor 280 will sense the flyback current and will produce a signal indicative of that current. The current signal from the second current sensor 280 will permit ECM 110 to sense current flow through the solenoid coil 130 when the modulation switch 160 is open.

Several modes of operation exist for the solenoid driver circuit 100. The first mode is an initialization mode wherein the driver circuit 100 must be initialized whenever the circuit has been disconnected from the low battery supply for an extended period of time, or the capacitor 230 has otherwise discharged below a desired voltage. In this case, prior to issuing a current command, ECM 110 must initialize the system to charge the capacitor 230. The second mode of operation is a normal operation mode. A detailed description of the operation of the initialization mode and the normal operation mode is set forth in U.S. Pat. No. 5,717,562 and will not be repeated herein.

Once ECM 110 verifies that the voltage level across the high capacitor voltage 230, as measured by the voltage sensor 220, is within the predetermined tolerance of the desired voltage level, normal operation of the driver circuit 100 will occur. When solenoid coil 130 is to be energized, ECM 110 outputs appropriate signals to the high voltage select switch 150 and the modulation switch 160 to close such switches. As a result, the high voltage capacitor 230 is now connected to the solenoid coil 130 thereby causing current to flow through the coil 130. Current flow through solenoid 130 increases until the current level reaches a predetermined current level such as the current $I_1$ referenced in the timing diagram illustrated in FIG. 3. Current level $I_1$ is a desired current level sufficient to allow the solenoid coil 130 to operate the actuator (not shown) or otherwise cause the actuator to move to the "on" position. ECM 110 then monitors the current signal produced by the current sensor 260 via conductive path 261 and when the current through the solenoid coil 130 reaches $I_1$, ECM 110 discontinues its control signal to switches 150 and 160 thereby causing the high voltage select switch 150 and the modulation switch 160 to open.

At about the same time, ECM 110 outputs a control signal to close the select switch 140. Since the modulation switch 160 is now open, the solenoid coil 130 generates back EMF causing current to continue to flow along the flyback path A, through the diode 210, the current sensor 280, the voltage sensor 220, and the back EMF charges the high voltage capacitor 230. As the capacitor 230 charges, the current level through the solenoid coil 130 decreases. ECM 110 monitors the current signal produced by the current sensor 280 and when the current signal indicates a current flow though the solenoid coil 130 that is less than a second predetermined current level $I_2$ as again illustrated in the timing diagram of FIG. 3, ECM 110 outputs a control signal to close the modulation switch 160. In a preferred embodiment, the second predetermined current level $I_2$ is a pre-selected tolerance less than the first predetermined level $I_1$. Current level $I_2$ is likewise sufficient to allow the solenoid coil 130 to operate or move the actuator (not shown) to which it is connected.

As shown in FIG. 1, when the select switch 140 and the modulation switch 160 are closed, the battery voltage 170 is applied across the solenoid coil 130 thereby increasing the current flow though the coil 130. ECM 110 thereafter modulates the production of the output signal to the modulation switch 160 thereby causing such switch to modulate between an open position when the current flow through the solenoid coil 130 exceeds current level $I_1$ and a closed position when the current level through the solenoid coil 130 is less than the current level $I_2$. In this way, current flow through the solenoid coil 130 modulates between the current levels $I_1$ and $I_2$ while the current command signal is at a desired voltage level. During this period of modulation, the back EMF created by the solenoid coil 130, when the modulation switch 160 is opened, is used to charge the high voltage capacitor 230.

When the voltage from capacitor 230 is applied across the solenoid coil 130, the capacitor voltage drops as the current begins to flow through such coil. However, when the current level initially reaches the predetermined current level $I_1$, ECM 110 thereafter connects the battery 170 to the solenoid coil 130 and uses the back EMF to recharge the capacitor 230. As a result, the capacitor voltage increases during each period when the modulation switch 160 is open. The high voltage capacitor 230 continues to recharge until the capacitor voltage exceeds some desired voltage or the command signal is discontinued and current is no longer flowing through the solenoid coil 130. In some instances, as is fully explained in U.S. Pat. No. 5,717,562, the voltage of capacitor 230 may exceed the desired voltage level at which time such capacitor may again be used to drive the solenoid coil until the voltage level again drops to within a desired level. Because the solenoid driver circuit 100 uses the battery voltage 170 to supply current to the solenoid coil 130 during the modulation of the current between the predetermined levels $I_1$ and $I_2$, and because the current created by back EMF is used to charge the high voltage capacitor 230, the driver circuit 100 is able to maintain the voltage of the high voltage capacitor 230 at a desired level without having a dedicated high voltage power supply circuit. The desired level is preferably a higher voltage than the battery voltage 170 in order to achieve improved response time and improved repeatability.

Figure 2:
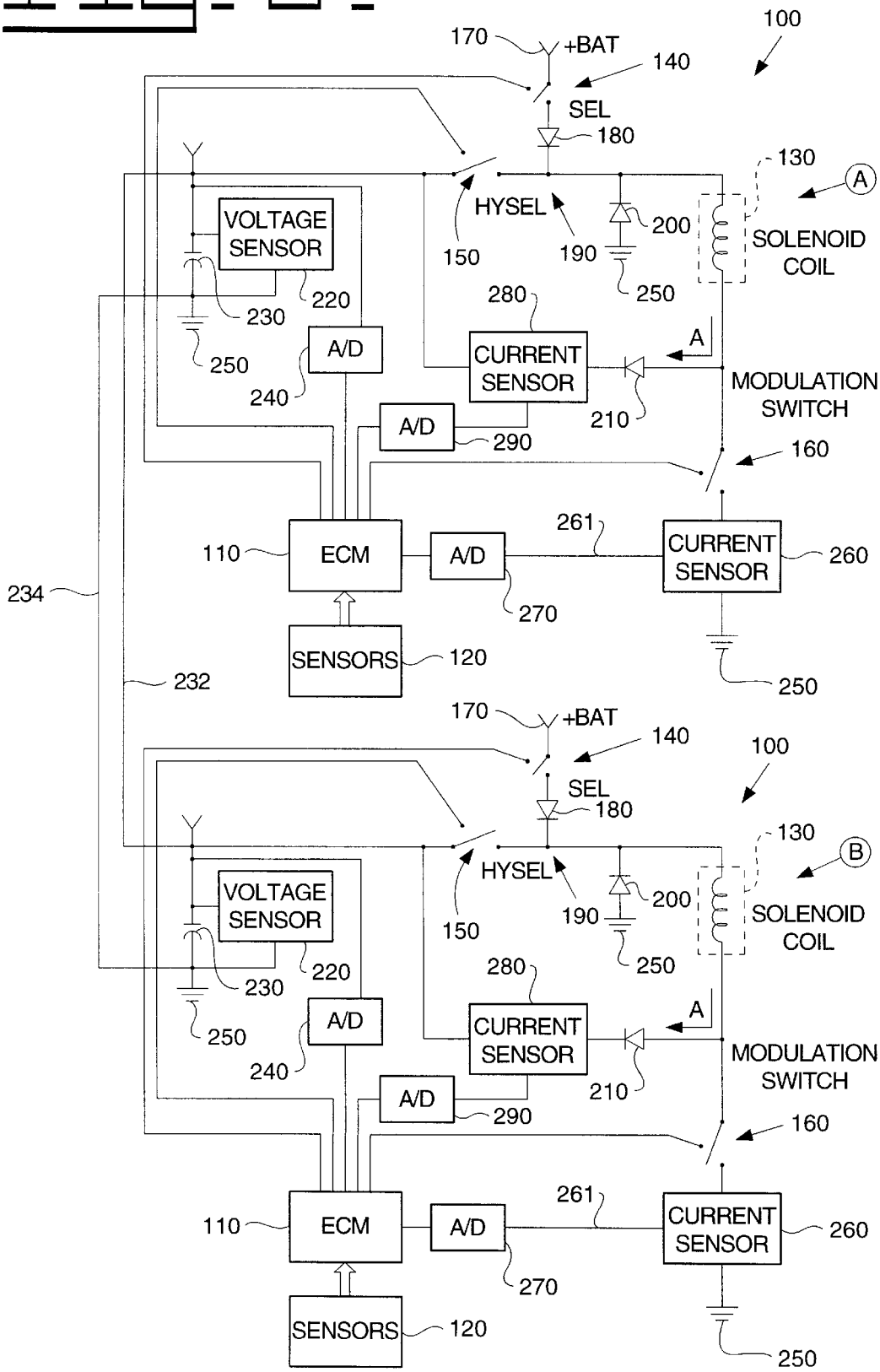
FIG. 2 is a schematic diagram of one embodiment of the present circuit configuration constructed in accordance with the teachings of the present invention utilizing the solenoid driver circuit illustrated in FIG. 1.

The present invention resides in using a plurality of the solenoid driver circuits 100 and one or more electronic controllers to control the current rise time through a plurality of solenoid coils used in a wide variety of different solenoid actuator applications such as for controlling the delivery of fuel to a plurality of fuel injectors. More particularly, the present invention resides in coupling together the high voltage capacitors associated with each solenoid driver circuit 100 in a parallel arrangement such that a plurality of the high voltage capacitors can be recharged from the current generated by the back EMF associated with one or more of the solenoid coils 130 during the period of modulation of switch 160. For example, the solenoid driver circuit 100 could be utilized to control a single fuel injector associated with a particular engine. Thus, in the case of a six cylinder engine, there would typically be six such circuits coupled together in a parallel arrangement. FIG. 2 illustrates two such circuits 100 wherein the high voltage capacitors 230 associated with such circuits are tied together in parallel arrangement via conductive paths 232 and 234. Although not illustrated, in the case of a six cylinder engine having one driver circuit 100 associated with each fuel injector, the high voltage capacitors associated with all six of such driver circuits would be connected in parallel arrangement similar to the two driver circuits 100 illustrated in FIG. 2.

Figure 4:
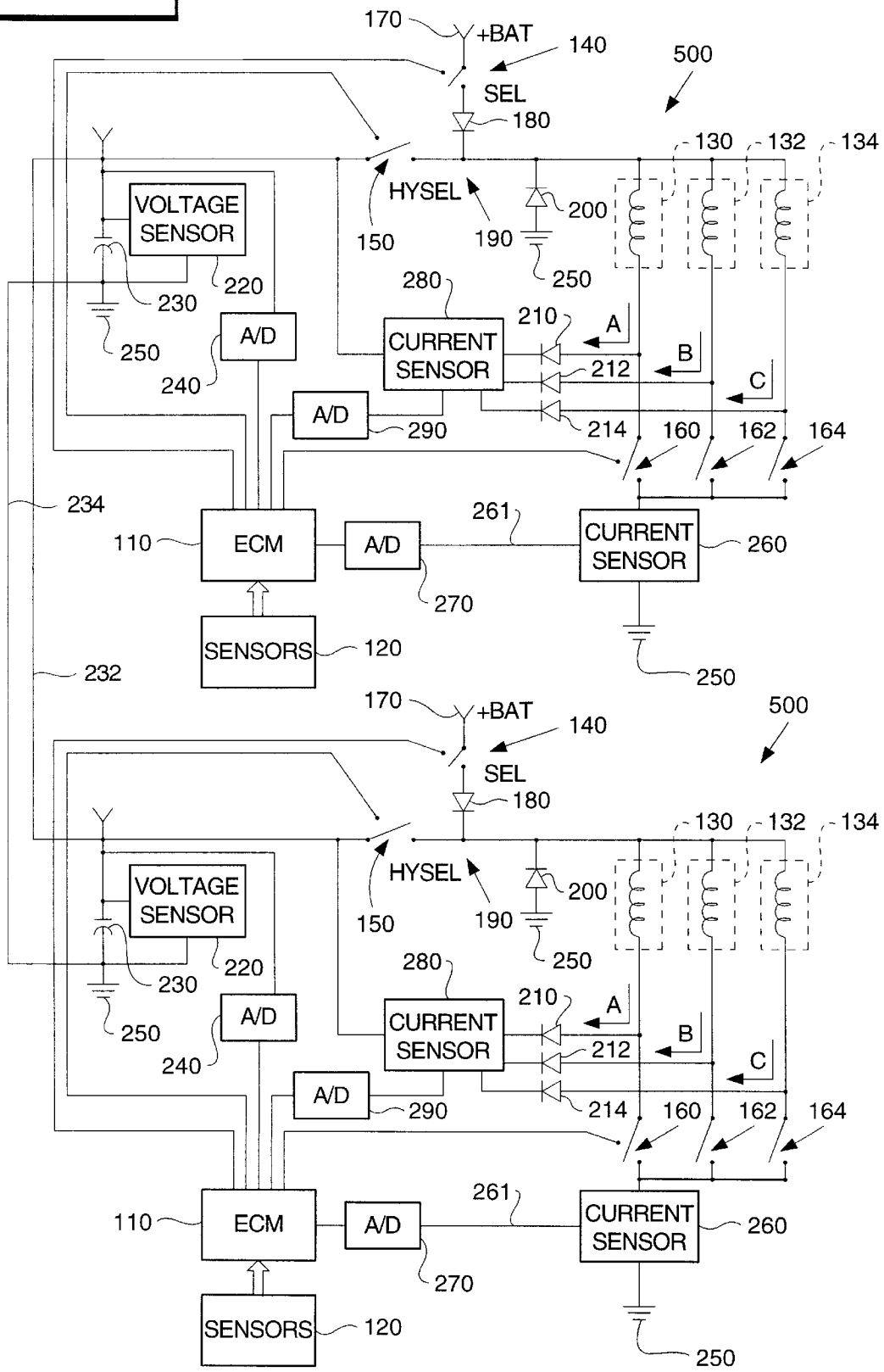
FIG. 4 is a schematic diagram illustrating another embodiment of the present circuit configuration constructed in accordance with the teachings of the present invention.

It is also recognized that the solenoid actuators such as fuel injection actuators could be grouped together in any number of injectors such as in banks of two and three injectors wherein one solenoid driver circuit 100 would control the operation of two, three or any plurality of fuel injectors such as the circuit arrangement illustrated in FIG. 4. In the solenoid driver circuit 100 disclosed in U.S. Pat. No. 5,717,562 and explained above with reference to FIG. 1, recharging of the high voltage capacitor 230 occurs primarily after fuel injection for that particular fuel injector has occurred. In the present invention, as will be hereinafter explained, charging of the high voltage capacitors 230 can occur during fuel injection, or while a particular solenoid coil 130 is actually operating or moving the valve or other mechanism associated with the particular actuator, and such recharging can take place on multiple cylinders at the same time.

Figure 3:
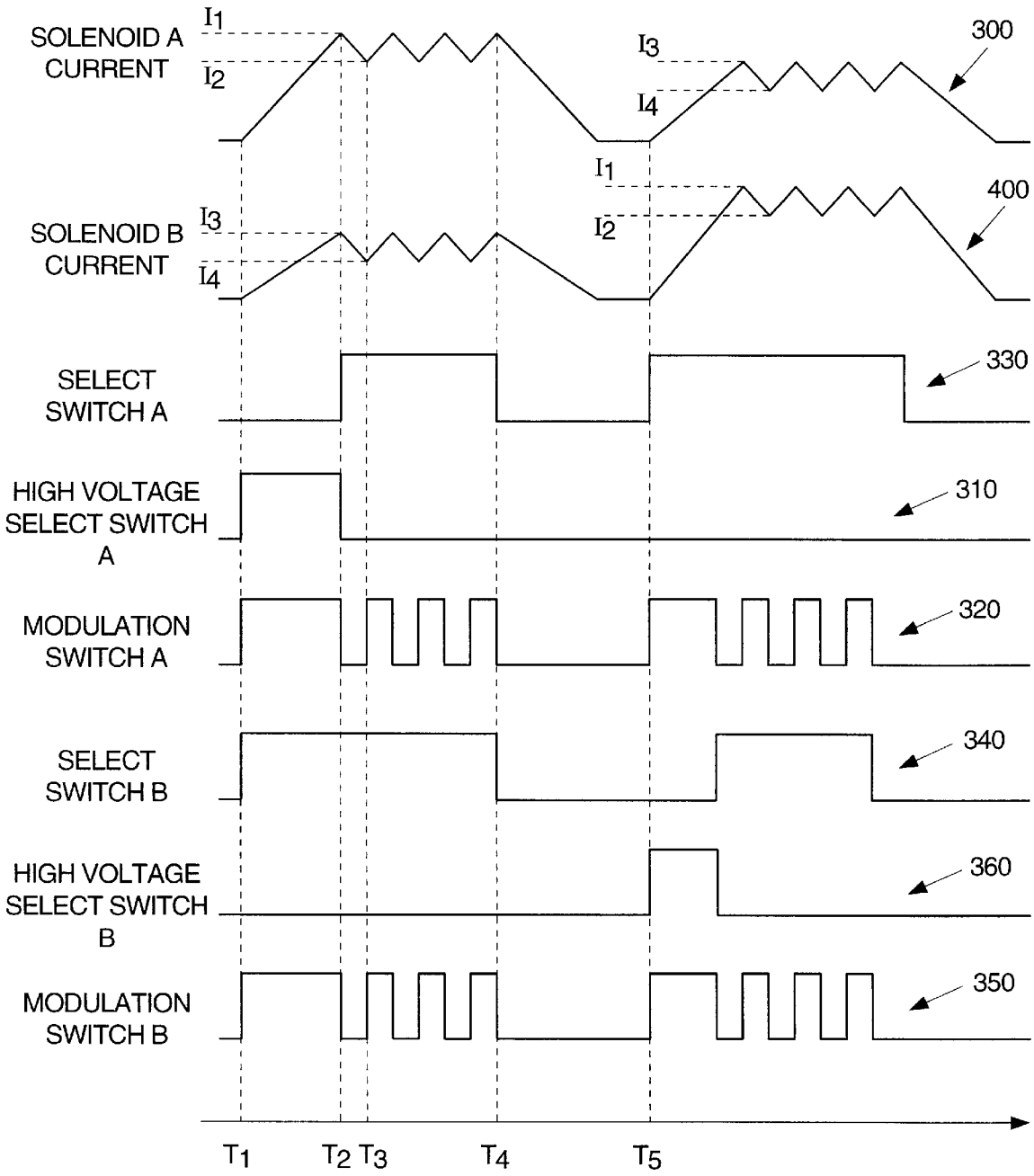
FIG. 3 illustrates a general timing diagram for a normal mode of operation used in connection with the embodiment of the present invention illustrated in FIG. 2.

For ease of explanation, the upper driver circuit 100 illustrated in FIG. 2 has been designated as controlling fuel injector or solenoid coil A and the lower driver circuit 100 illustrated in FIG. 2 has been designated as controlling fuel injector or solenoid coil B. In this regard, FIG. 3 illustrates a representative timing diagram for a preferred embodiment of the present invention as it operates in the normal operational mode. This figure shows current levels, control signals, and the various relationships between the operation of the various switches and the solenoid currents 300 and 400 for both solenoids A and B. At a time $T_1$, the ECM associated with solenoid A will output a signal calling for a predetermined voltage level corresponding to the desired current level $I_1$, the current level $I_1$ being more than the solenoid coil A requires to cause the actuator to move to the "on" position. At the same time, the ECM 110 also produces a control signal 310 to the high voltage select switch 150 thereby causing the switch 150 to close, and a control signal 320 to the modulation switch 160 thereby causing the modulation switch 160 to close. As a result, the high voltage capacitor 230 is now connected to the solenoid A thereby causing current to flow therethrough. As shown in FIG. 3, current flow through solenoid A increases until the current level reaches $I_1$ at the time $T_2$. When the current through solenoid A reaches $I_1$, the ECM will discontinue the control signals 310 and 320 thereby causing the high voltage select switch 150 and the modulation switch 160 to open.

At about the same time, the ECM outputs a control signal 330 thereby causing the select switch 140 to close. Since the modulation switch 160 is now open, the solenoid A generates back EMF causing current to continue to flow along the flyback path A to charge the high voltage capacitor 230. When the current level through solenoid A decreases to current level $I_2$, ECM 110, at time $T_3$, will output a signal 320 to close the modulation switch 160. As previously explained, when the select switch 140 and the modulation switch 160 are closed, the battery voltage 170 is applied across solenoid A thereby increasing the current flow through the solenoid back to current level $I_1$. The ECM thereafter modulates the current of solenoid A between the $I_1$ and $I_2$ current levels. During this period of modulation, the current generated by the back EMF associated with solenoid A, when the modulation switch 160 is open, is used to charge the high voltage capacitor for solenoid A. At time $T_4$, the fuel injection controlled by solenoid A is complete and the ECM will output control signals 320 and 330 to again open the select switch 140 and the modulation switch 160. At this time, all three switches 140, 150, and 160 are in their open position. As a result, the current generated by the back EMF associated with solenoid A is again used to charge the high voltage capacitor 230 in the driver circuit 100 associated with solenoid A.

Depending upon the particular size and timing of the engine involved, some fuel injectors will be active and some fuel injectors will be inactive. In the illustration set forth in FIG. 2, while solenoid A is active to control fuel injection into a particular cylinder, solenoid B is not active to control fuel injection and the current generated by the back EMF associated with solenoid B is used to charge the high voltage capacitor associated with the solenoid B driver circuit. This recharging of the high voltage capacitor in the solenoid B circuit will also aid in recharging the high voltage capacitor in the solenoid A circuit since such high voltage capacitors are coupled together in parallel. As a result, the high voltage capacitor in the solenoid A circuit can be recharged even while the high voltage select switch 150 in the solenoid A driver circuit is closed and the capacitor 230 is being utilized to pass current through solenoid A.

Still further, to decrease the voltage recovery time of the high voltage capacitors associated with solenoids A and B, a current level $I_3$ is passed through the solenoid coil after fuel injection is completed. For example, at time $T_1$ while solenoid A is being commanded to the $I_1$ current level, the ECM associated with the driver circuit of solenoid B outputs a signal to a second predetermined voltage level corresponding to a desired current level $I_3$. Importantly, current level $I_3$ is less than that which solenoid B requires to operate the actuator, that is, to cause the actuator to move to the "on" position. When the ECM associated with solenoid B commands current level $I_3$ at time $T_1$, it likewise outputs control signals 340 and 350 to close the select switch 140 and the modulation switch 160. This will allow the battery voltage 170 to be applied across solenoid B thereby increasing the current flow through the coil. When the current level reaches $I_3$ in solenoid B at time $T_2$, ECM 110 will output a signal 350 to open the modulation switch 160. Since the high voltage select switch 150 associated with the solenoid B circuit is likewise open as represented by the ECM control signal 360 for the entire time duration $T_1$ through $T_4$, solenoid B generates back EMF and the current generated by such back EMF recharges the high voltage capacitor 230 in the solenoid B circuit. As the solenoid B high voltage capacitor charges, the current level through solenoid B decreases and ECM 110 will output a signal 350 to again close the modulation switch 160 at time $T_3$ when the current level in solenoid B drops to a fourth predetermined current level $I_4$. ECM 110 will thereafter modulate the opening and closing of the modulation switch 160 between current levels $I_3$ and $I_4$, both of which current levels are less than the current required by solenoid B to operator or move the actuator. This modulation will continue until time $T_4$, which time coincides with the completion of fuel injection by solenoid A and is preparatory to the beginning of fuel injection by solenoid B which begins to occur at time $T_5$.

At time $T_5$, solenoid B will be commanded to a current level $I_1$ whereas, at time $T_5$, solenoid A will be commanded to a current level $I_3$ to recharge the high voltage capacitor associated with both driver circuits. Importantly, during the time period $T_1$ through $T_4$, the current generated by the back EMF associated with the solenoid B circuit is not only recharging the high voltage capacitor associated with the solenoid B circuit, but such back EMF is also recharging the high voltage capacitor associated with the solenoid A circuit through conductive paths to 232 and 234.

As can be seen from the representative timing diagram set forth in FIG. 3, the high voltage capacitor associated with solenoid B, which is not operating or moving its associated actuator, will be recharged during the same time period that solenoid A is operating or moving its associated actuator, and the current generated by the back EMF associated with the solenoid B circuit will also recharge the high voltage capacitor of the solenoid A circuit even while the capacitor in driver circuit A is providing current flow through solenoid A. In addition, the current level $I_3$ passed through solenoid B will provide for faster recharging of both high voltage capacitors.

In a six cylinder engine, if a solenoid driver circuit 100 was associated with each cylinder and each driver circuit 100 was coupled to an adjacent driver circuit 100 as illustrated in FIG. 2, and if, for example, only one fuel injector was active at any particular point in time in providing fuel injection to the engine, the remaining five fuel injector solenoids would be used to not only recharge the high voltage capacitor associated with each respective solenoid driver circuit 100, but all five of these high voltage capacitors could be utilized to recharge each other as well as the high voltage capacitor associated with the active fuel injector solenoid circuit. It is likewise recognized and anticipated that as the number of cylinders of a particular engine increases, and if two or more fuel injector solenoids are active in providing fuel injection to the engine at the same time, the current generated by the back EMF associated with the remaining fuel injector solenoids which are not active in providing fuel injection at that particular point in time will be utilized to recharge all of the high voltage capacitors. This greatly improves response time and greatly improves the repeatability of providing consistently reproducible stroke characteristics.

It is also recognized and anticipated that each solenoid driver circuit 100 may include additional solenoid coils in parallel with the respective solenoids 130 illustrated in FIG. 2. This embodiment is illustrated in FIG. 4 wherein each solenoid driver circuit 500 would control the operation of three fuel injectors. In this particular embodiment, each solenoid coil 130, 132 and 134 is connected to the common select switch 140, a common first diode 180, and each solenoid has it own modulation switch 160, 162, and 164. In addition, each flyback current path A, B and C has its own diode 210, 212 and 214 respectively. The solenoid driver circuits 500 will operate in substantially the same manner as previously described with respect to the solenoid driver circuit 100 except that the modulation switches 160, 162 and 164 will be selectively activated by ECM 110 to designate which of the respective solenoid coils will be used for fuel injection at any one particular time. In all other respects, the driver circuit operation as well as its recharging capability is substantially identical as previously described. In addition, the operation and recharging capability of the pair of solenoid driver circuits 500 illustrated in FIG. 4 is again substantially identical to the operation and recharging capability of the pair of driver circuits 100 illustrated in FIG. 2. It is also recognized that the additional solenoid coils 132 and 134 in driver circuits 500 could likewise be connected in parallel in other ways such as by using separate select switches and a common modulation switch without departing from the spirit and scope of the present invention.

Industrial Applicability

As described herein, the present energy recovery circuit configuration has particular utility in a wide variety of different solenoid actuator applications besides the specific fuel injector application disclosed and described herein. More particularly, the present invention is particularly advantageous in those actuator applications where it is important to control the current rise time through the solenoid coil, and where it is important to keep the high voltage supply at a desired level. In addition, the present invention allows the high voltage supply associated with each driver circuit to be charged by multiple sources, even when that particular high voltage supply is providing current flow to one or more solenoid coils associated with that particular driver circuit.

Although the circuit configurations illustrated in FIGS. 2 and 4 show a separate ECM associated with each driver circuit 100 and/or 500, it is recognized and anticipated that one ECM could control the operations of any plurality of driver circuits 100 and/or 500 depending upon the particular application involved. Still further, as is evident from the foregoing description, certain aspects of the present invention are not limited to the particular details of the examples illustrated herein, and it is therefore contemplated that other modifications and applications will occur to those skilled in the art. It is accordingly intended that the appended claims cover all such modifications, variations, alternative embodiments, equivalents and other uses and applications which do not depart from the sprit and scope of the present invention.

Other aspects, objects and advantages of the present invention can be obtained from a study of the drawings, the disclosure and the appended claims.

What is claimed is:

1. An apparatus for recovering solenoid coil energy in a solenoid driver circuit comprising:

a first solenoid driver circuit including a solenoid coil for controlling the operation of an actuator; a high voltage capacitor coupled to said solenoid coil for providing current flow thereto; a high voltage select switch connecting said capacitor to said solenoid coil; a low voltage supply coupled to said solenoid coil; a select switch connecting said low voltage supply to said solenoid coil; a flyback current path connecting said solenoid coil with said high voltage capacitor; and an electronic controller coupled to said high voltage select switch and to said select switch and being operable to output control signals thereto;

a second solenoid driver circuit including a solenoid coil for controlling the operation of an actuator; and a high voltage capacitor coupled to said solenoid coil for providing current flow thereto and a flyback current path connecting said solenoid coil with said high voltage capacitor; and the high voltage capacitor of said first driver circuit being connected in parallel to the high voltage capacitor of said second driver circuit;

wherein the current generated by the back EMF of the solenoid coil associated with said second driver circuit is operable to charge the high voltage capacitor of said first driver circuit at a time when the high voltage capacitor of said first driver circuit is providing current flow through the solenoid coil of said first driver circuit.

2. The apparatus, as set forth in claim 1, wherein the current generated by the back EMF of the solenoid coil associated with said second driver circuit is operable to charge the high voltage capacitor of said first driver circuit at a time when the high voltage capacitor of said first driver circuit is not providing current flow through the solenoid coil of said first driver circuit.

3. The apparatus, as set forth in claim 1, wherein said first driver circuit include a modulation switch connected in series with said solenoid coil, said modulation switch being operable between an open and a closed position, said electronic controller selectively outputting signals to said high voltage select switch, said select switch, and said modulation switch to control current flow through the solenoid coil of said first driver circuit at at least one of a time when said solenoid coil does not have sufficient current flow therethrough to operate the actuator and a time when said solenoid coil has sufficient current flow therethrough to operate the actuator, said electronic controller modulating the current through said solenoid coil between first and second predetermined current levels, said first and second predetermined current levels being less than the current level required to allow said solenoid coil to operate the actuator, the back EMF created in said solenoid coil during modulation being used to charge the high voltage capacitor of said first driver circuit at a time when said modulation switch is in its open position.

4. The apparatus, as set forth in claim 1, wherein said second driver circuit includes a high voltage select switch connecting said high voltage capacitor to said solenoid coil; a low voltage supply coupled to said solenoid coil; a select switch connecting said low voltage supply to said solenoid coil; and an electronic controller coupled to said high voltage select switch and to said select switch and being operable to output signals thereto;

the electronic controller coupled to said second driver circuit selectively outputting signals to the high voltage select switch and the select switch of said second driver circuit for controlling the operation of said solenoid coil between a first condition wherein said high voltage capacitor provides current flow through said solenoid coil, a second condition wherein said low voltage supply provides current flow through said solenoid coil, and a third condition wherein no current flow is provided through said solenoid coil by either said high voltage capacitor or said low voltage supply;

the back EMF created in the solenoid coil of said second driver circuit during the time current flow is provided through said solenoid coil causing current to flow through said flyback current path to recharge the high voltage capacitor of said second driver circuit to a predetermined level at a time when no current flow is provided through said solenoid coil by said high voltage capacitor or said low voltage supply;

the current generated by the back EMF of the solenoid coil of said second driver circuit charging the high voltage capacitor of said first driver circuit.

5. The apparatus, as set forth in claim 1, wherein the current generated by the back EMF of the solenoid coil associated with said first driver circuit charges the high voltage capacitor of said second driver circuit at at least one of a time when the high voltage capacitor of said second driver circuit is providing current flow through the solenoid coil of said second driver circuit and a time when the high voltage capacitor of said second driver circuit is not providing current flow through the solenoid coil of said second driver circuit.

6. The apparatus, as set forth in claim 4, wherein said second driver circuit includes a modulation switch connected in series with said solenoid coil, said modulation switch being operable between an open and a closed position, said electronic controller selectively outputting signals to said high voltage select switch, said select switch, and said modulation switch to control current flow through the solenoid coil of said second driver circuit at a time when said solenoid coil does not have sufficient current flow therethrough to operate the actuator, said electronic controller modulating the current through said solenoid coil between first and second predetermined current levels, said first and second predetermined current levels being less than the current level required to allow said solenoid coil to operate the actuator, the back EMF created in said solenoid coil during modulation being used to charge the high voltage capacitor of said second driver circuit at a time when said modulation switch is in its open position.

7. The apparatus, as set forth in claim 4, wherein the electronic controller associated with said second driver circuit is the same electronic controller associated with said first driver circuit.

8. The apparatus, as set forth in claim 1, including a plurality of additional solenoid driver circuits, each additional solenoid driver circuit including a solenoid coil for controlling the operation of an actuator and a high voltage capacitor coupled to said solenoid coil for providing current flow thereto, all of the high voltage capacitors of said additional driver circuits being coupled together such that the high voltage capacitor associated with one of said additional driver circuits is connected in parallel with the high voltage capacitor associated with another of such additional driver circuits, and one of said additional high voltage capacitors being connected in parallel to the high voltage capacitor of said second driver circuit, the current generated by the back EMF of the solenoid coil associated with said first driver circuit charging at least some plurality of the high voltage capacitors of said additional driver circuits at a time when no current flow is provided through the solenoid coil of said first driver circuit by said high voltage capacitor or said low voltage supply.

9. The apparatus of claim 1, wherein said electronic controller is operable to selectively output signals to the high voltage select switch and the select switch of said first driver circuit for controlling the operation of said solenoid coil between a first condition wherein said high voltage capacitor provides current flow through said solenoid coil, a second condition wherein said low voltage supply provides current flow through said solenoid coil, and a third condition wherein no current flow is provided through said solenoid coil by either said high voltage capacitor or said low voltage supply;

wherein the back EMF created in the solenoid coil of said first driver circuit during the time current flow is provided through said solenoid coil causing current to flow through said flyback current path to recharge the high voltage capacitor of said first driver circuit to a predetermined level at a time when no current flow is provided through said solenoid coil by said high voltage capacitor or said low voltage supply; and wherein the current generated by the back EMF of the solenoid coil associated with said first driver circuit is operable to charge the high voltage capacitor of said second driver.

10. An apparatus for recovering solenoid coil energy in a solenoid driver circuit comprising:

a first solenoid driver circuit including at least one solenoid coil for controlling the operation of an actuator; a high voltage supply coupled to said at least one solenoid coil for providing current flow thereto; a high voltage select switch connecting said high voltage supply to said at least one solenoid coil; a low voltage supply coupled to said at least one solenoid coil; a select switch connecting said low voltage supply to said at least one solenoid coil; a modulation switch connected in series with said at least one solenoid coil; a flyback current path connecting said at least one solenoid coil with said high voltage supply; and an electronic controller coupled to said high voltage select switch, said select switch, and said modulation switch and being operable to output control signals thereto to control the opening and closing of said switches;

a second solenoid driver circuit including at least one solenoid coil for controlling the operation of an actuator; a high voltage supply coupled to said at least one solenoid coil for providing current flow thereto and a flyback current path connecting said solenoid coil with said high voltage supply;

the high voltage supply of said first driver circuit being connected in parallel to the high voltage supply of said second driver circuit;

said electronic controller selectively outputting signals to said high voltage select switch, said select switch, and said modulation switch of said first driver circuit to provide current flow through said at least one solenoid coil sufficient to allow said at least one solenoid coil to operate the actuator for a predetermined time;

said electronic controller operable to selectively output signals to said high voltage select switch, said select switch, and said modulation switch of said first driver circuit to control the current flow through said at least one solenoid coil at a current level which is not sufficient to allow said at least one solenoid coil to operate the actuator for a predetermined time;

the at least one solenoid coil of said first driver circuit generating back EMF and causing current to flow through said flyback current path to recharge the high voltage supply of said first driver circuit to a predetermined level at a time when the current flow through said at least one solenoid coil is not sufficient to allow said at least one solenoid coil to operate the actuator;

the current generated by the back EMF of the at least one solenoid coil of said second driver circuit operable to charge the high voltage supply of said first driver circuit when said first driver circuit is providing current flow to said solenoid coil.

11. The apparatus, as set forth in claim 10, wherein the at least one solenoid coil of said second driver circuit is operable between a first condition wherein current flow through said at least one solenoid coil is sufficient to operate the actuator, and a second condition wherein the current flow through said solenoid coil is not sufficient to operate the actuator, the current generated by the back EMF of the at least one solenoid coil of said first driver circuit charging the high voltage supply of said second driver circuit at a time when current flow through the at least one solenoid coil of said second driver circuit is at least one of sufficient to operate the actuator and not sufficient to operate the actuator.

12. An apparatus for recovering solenoid coil energy in a solenoid driver circuit comprising:

a first solenoid driver circuit including a solenoid coil for controlling the operation of an actuator; a high voltage capacitor coupled to said solenoid coil for providing current flow thereto; a high voltage select switch connecting said capacitor to said solenoid coil; a low voltage supply coupled to said solenoid coil for providing current flow thereto; a select switch connecting said low voltage supply to said solenoid coil; a modulation switch connected in series with said solenoid coil, said modulation switch being operable between an open and a closed position; a flyback current path connecting said solenoid coil with said high voltage capacitor; and an electronic controller coupled to said high voltage select switch, said select switch, and said modulation switch and being operable to output control signals thereto;

a second solenoid driver circuit including a solenoid coil for controlling the operation of an actuator; a high voltage capacitor coupled to said solenoid coil for providing current flow thereto; and a flyback current path connecting said solenoid coil with said high voltage capacitor;

the high voltage capacitor of said first driver circuit being connected in parallel to the high voltage capacitor of said second driver circuit;

said electronic controller operable to selectively output signals to the high voltage select switch, the select switch, and said modulation switch of said first driver circuit for controlling the operation of said solenoid coil between a first condition wherein said high voltage capacitor provides current flow through said solenoid coil, a second condition wherein said low voltage supply provides current flow through said solenoid coil, and a third condition wherein no current flow is provided through said solenoid coil by said high voltage capacitor or said low voltage supply;

said electronic controller operable to selectively output signals to said high voltage select switch, said select switch, and said modulation switch to control current flow through the solenoid coil of said first driver circuit at a time when the current flow through said solenoid coil is being provided by said high voltage capacitor or said low voltage supply, said electronic controller modulating the current through said solenoid coil between first and second predetermined current levels;

the solenoid coil of said first driver circuit operable to generate back EMF during the modulation of the current through said solenoid coil between said first and second predetermined current levels, the back EMF created in said solenoid coil during modulation being used to charge the high voltage capacitor of said first driver circuit at a time when said modulation switch is in its open position;

the current generated by the back EMF of the solenoid coil of said first driver circuit operable to charge the high voltage capacitor of said second driver circuit at a time when said high voltage capacitor is providing current flow to said second driver circuit.

13. An apparatus for recovering solenoid coil energy in a solenoid driver circuit comprising:

a first solenoid driver circuit including a plurality of solenoid coils, each solenoid coil controlling the operation of a particular actuator; a high voltage supply coupled to each of said solenoid coils for providing current flow thereto; a high voltage select switch connecting said high voltage supply to said plurality of solenoid coils; a low voltage supply coupled to said plurality of solenoid coils; a select switch connecting said low voltage supply to said plurality of solenoid coils; a modulation switch connected in series with each of said solenoid coils; a flyback current path connecting each of said plurality of solenoid coils with said high voltage supply; and an electronic controller coupled to said high voltage select switch, said select switch, and said modulation switches and being operable to output control signals thereto to control the opening and closing of said switches;

a second solenoid driver circuit including at least one solenoid coil for controlling the operation of at least one actuator; a high voltage supply coupled to said at least one solenoid coil for providing current flow thereto and a flyback current path connecting said at least one solenoid coil with said high voltage supply;

the high voltage supply of said first driver circuit being connected in parallel to the high voltage supply of said second driver circuit;

said electronic controller operable to selectively outputting signals to said high voltage select switch, said select switch, and said modulation switches of said first driver circuit to selectively provide current flow through said plurality of solenoid coils sufficient to allow each of said solenoid coils to operate its particular actuator for a predetermined time;

said electronic controller operable to selectively output signals to said high voltage select switch, said select switch, and said modulation switches of said first driver circuit to selectively provide current flow through said plurality of solenoid coils at a current level which is not sufficient to allow each of said solenoid coils to operate its particular actuator for a predetermined time;

each of said solenoid coils associated with said first driver circuit generating back EMF and causing current to flow through its respective flyback current path to charge the high voltage supply of said first driver circuit to a predetermined level at a time when the current flow through each of said respective solenoid coils is not sufficient to allow each of said solenoid coils to operate its particular actuator;

the current generated by the back EMF of each of said solenoid coils of said first driver circuit operable to charge the high voltage supply of said second driver circuit at a time when said high voltage supply is providing current to said at least one solenoid coil of said second solenoid driver circuit.

14. A circuit for controlling a plurality of operations effected through a plurality of solenoids comprising first and second driver circuit portions and a low voltage source, each of said first and second driver circuit portions including a solenoid controlled portion and an initiating portion, each initiating portion including a high voltage capacitor, each solenoid controlled portion including a solenoid coil, a current control portion, and a current sensing portion, said current control portion operable to generate current command signals under predetermined conditions, said high voltage capacitor of each of said first and second circuit portions being operatively connectable to the solenoid coil of such circuit portion in response to a current command signal to supply high voltage thereto and disconnectable from said solenoid coil when said current sensing portion of such circuit portion senses current through said solenoid exceeding a respective first predetermined level, said solenoid coil of each of said first and second circuit portions being operatively connectable to said low voltage source when said current sensing portion of such circuit portion falls below a respective second predetermined level and disconnectable from said low voltage source when said current sensing portion of such circuit portion exceeds said respective first predetermined level, said solenoid coil of each of said first and second circuit portions having a circuit connection back to said high voltage capacitor of such circuit portion to supply charging current thereto from said solenoid coil when either said high voltage supply from said high voltage capacitor is disconnected or said low voltage source is disconnected from said solenoid coil, said high voltage capacitors of said first and second circuit portions being connected to one another in parallel, whereby said high voltage capacitors of both said first and second circuit portions are charged with energy created in the solenoid coil inductances of said first and second circuit portions when charging current is supplied by either of said solenoid coils of said first or second circuit portions, said charging operable to occur when one of the high voltage capacitors is supplying high voltage to said solenoid coil.

15. An apparatus for recovering solenoid coil energy in a solenoid driver circuit, comprising:

a first capacitor operable to store a relatively high voltage;

a first solenoid coil operable to be switchably coupled with the first capacitor;

a first flyback current path coupling the first solenoid coil with the first capacitor and operable to couple back EMF of the first solenoid coil with the first capacitor;

a second capacitor coupled in parallel with the first capacitor, the second capacitor operable to store a relatively high voltage;

a second solenoid coil operable to be switchably coupled with the second capacitor; and a second flyback current path coupling the second solenoid coil with the second capacitor and operable to couple back EMF of the second solenoid coil with the second capacitor and the first capacitor, the back EMF of the second solenoid coil operable to charge the first capacitor when the first capacitor is discharging through the first solenoid coil.

* * * * *